US007705254B2

(12) United States Patent
Kim et al.

(10) Patent No.: US 7,705,254 B2
(45) Date of Patent: Apr. 27, 2010

(54) MICRO SWITCH DEVICE AND MANUFACTURING METHOD

(75) Inventors: Che Heung Kim, Yongin-si (KR); In Sang Song, Yongin-si (KR); Sang Wook Kwon, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 492 days.

(21) Appl. No.: 11/768,207

(22) Filed: Jun. 26, 2007

(65) Prior Publication Data

US 2008/0156624 A1 Jul. 3, 2008

(30) Foreign Application Priority Data

Dec. 29, 2006 (KR) ..... 10-2006-0138720

(51) Int. Cl.
*H01H 57/00* (2006.01)

(52) U.S. Cl. ..... 200/181; 335/78

(58) Field of Classification Search ..... 200/181; 310/330–332, 348, 349; 333/105, 133, 187–189, 333/262; 335/78
See application file for complete search history.

(56) References Cited

U.S. PATENT DOCUMENTS 6,717,496 B2 * 4/2004 Feng et al. ..... 335/78
6,894,592 B2 * 5/2005 Shen et al. ..... 335/78
6,992,551 B2 * 1/2006 Shimizu et al. ..... 335/78
7,268,653 B2 * 9/2007 Bouche ..... 335/78
7,382,218 B2 * 6/2008 Charvet ..... 335/78
7,420,135 B2 * 9/2008 Lee et al. ..... 200/181
7,463,125 B2 * 12/2008 Sridhar et al. ..... 335/78
7,501,911 B2 * 3/2009 Hong et al. ..... 333/105

FOREIGN PATENT DOCUMENTS

KR 10-2006-0035078 A 4/2006
KR 1020060068914 A 6/2006
KR 10-0633101 B1 9/2006
KR 10-0650272 B1 11/2006
WO 03017301 A1 2/2003

* cited by examiner

*Primary Examiner*—Michael A Friedhofer
(74) *Attorney, Agent, or Firm*—Sughrue Mion, PLLC

(57) ABSTRACT

A micro switch device includes a switch substrate, an electrostatic cover which is separated from the switch substrate, and a bezel which limits a movable area of the electrostatic cover. An input terminal, an output terminal, a first driving electrode, and a second driving electrode are formed on the switch substrate, and the electrostatic cover is physically separated from the switch substrate. In this instance, since the electrostatic cover is physically separated from the switch substrate, the electrostatic cover is not supported by the switch substrate and is able to move within a range, predetermined by the bezel. The electrostatic cover is electrically connected to the second driving electrode, and is able to easily operate with an electrostatic force at a lower power.

28 Claims, 17 Drawing Sheets

FIG. 10

| | | Controllability | Stability | Processibility |
|---|---|---|---|---|
| CASE 1 | Heavy compressive | Low | Bad | Bad |
| | Slight compressive | | | |
| CASE 2 | Compressive | Large | Medium | Medium |
| | Tensile | | | |
| CASE 3 | Slight tensile | Medium | Good | Good |
| | Heavy tensile | | | |
| CASE 4 | Slight tensile | Good | Good | Good |
| | Heavy tensile | | | |
| | Slight tensile | | | |

MICRO SWITCH DEVICE AND MANUFACTURING METHOD

CROSS-REFERENCE TO RELATED APPLICATION

This application claims priority from Korean Patent Application No. 10-2006-0138720, filed on Dec. 29, 2006, in the Korean Intellectual Property Office, the entire disclosure of which is incorporated herein by reference.

BACKGROUND OF THE INVENTION

1. Field of the Invention

Devices and manufacturing methods consistent with the present invention relate to a micro switch device and a micro switch device manufacturing method which can be used for a radio frequency (RF) antenna module and the like.

2. Description of Related Art

A switch having a micro structure may be used in a multi-band or a module of a multi-mode, and also may be used in various bands since the switch having the micro structure has a feature of a low loss within 1 dB, and has an isolation greater than approximately 40 dB in all bands within approximately 10 GHz, including a direct current (DC). In addition, in an RF device, the switch having the micro structure may be used to manufacture a switch, a switchable varactor, and an inductor, and may be used as a basic antenna.

FIG. 1 is a perspective view illustrating a related art micro switch device 1, and FIG. 2 is a front view illustrating the micro switch device 1 of FIG. 1.

Referring to FIGS. 1 and 2, the related art micro switch device 1 includes a substrate 10, a driving stage 20 on the substrate 10, a spring 30, fixed electrodes 52 and 54, an input terminal 62, and an output terminal 64. The driving stage 20 is located on a top of the substrate 10, and the driving stage 20 is supported by the spring 30 which is expanded from four corners. Since ends of the spring 30 are supported by an anchor 32, the driving stage 20 may be spaced apart from the top of the substrate 10, and may be horizontally fixed.

The driving stage 20 includes the driving electrodes 22 and 24 on both sides of the driving stage 20, and includes a connection point 26 between the driving electrodes 22 and 24. The fixed electrodes 52 and 54 are located on a bottom of the driving electrodes 22 and 24, and the input terminal 62 and the output terminal 64 are located on a bottom of the connection portion 26 for switching.

The micro switch device 1 is generally used for an RF module, and in the micro switch device 1, the driving stage 20 moves in a vertical direction of the substrate 10 by an electrostatic force between the fixed electrodes 52 and 54 and the driving electrodes 22 and 24. In this instance, when the driving stage 20 moves to the substrate 10, the connection portion 26 is contacted to both the input terminal 62 and the output terminal 64 to allow an electric current between the terminals.

Referring to FIG. 2, the driving stages 20 on the substrate of the micro switch device 1 are spaced apart from each other by a predetermined distance by the anchors 32, and the connection portion 26 of both of the anchors 32 is suspended by both of the springs 30.

Generally, an entire driving stage 20 elastically deforms so that the connection portion 26 may connect the input terminal 62 with the output terminal 64. As illustrated in FIGS. 1 and 2, an elastic deformation occurs in both the driving stage 20 and the spring 30 so that the connection portion 26 connects the input terminal 62 with the output terminal 64, and the electrostatic force between the fixed electrodes 52 and 54 and the driving electrodes 22 and 24 may move the connection portion 26 to the input terminal 62 and the output terminal 64 since the electrostatic force is greater than an elastic resilience with respect to the elastic deformation. As the elastic resilience by the driving stage 20 and the spring 30 is large, a greater voltage difference is required to be supplied between the driving electrodes 22 and 24 and the fixed electrodes 52 and 54, and this may decrease reliability and efficiency of the micro switch device 1.

In addition, a distance between the driving stage 20 and the fixed electrodes 52 and 54 is an important issue when manufacturing the micro switch device 1. If the driving stage 20 and the fixed electrodes 52 and 54 are relatively close to each other, the micro switch device 1 may operate at a comparatively lower voltage. Conversely, if the driving stage 20 and the fixed electrodes 52 and 54 are relatively far from each other, the micro switch device 1 may not properly operate even when a higher voltage is supplied. Under other circumstances, the micro switch device may not properly operate due to residual substance such as dust, and the like, between the driving electrodes 22 and 24 and the fixed electrodes 52 and 54.

SUMMARY OF THE INVENTION

Exemplary embodiments of the present invention overcome the above disadvantages and other disadvantages not described above. In addition, the present invention is not required to overcome the disadvantages described above, and an exemplary embodiment of the present invention may not overcome any of the problems described above.

The present invention provides a micro switch device which can easily deform a stage or a membrane, and can operate micro switch device which can operate at a comparatively lower power.

The present invention also provides a micro switch device which is comparatively less influenced by a distance between electrodes to which an electrostatic force is applied, and is comparatively less influenced by a manufacturing process, such as manufacturing precision or manufacturing skill.

The present invention also provides a micro switch device which can be easily manufactured, and has great yield.

According to an aspect of the present invention, there is provided a micro switch device includes a switch substrate, an electrostatic cover which is separated from the switch substrate, and a bezel which limits a movable area of the electrostatic cover. An input terminal, an output terminal, a first driving electrode, and a second driving electrode are formed on the switch substrate, and the electrostatic cover is physically separated from the switch substrate. In this instance, since the electrostatic cover is physically separated from the switch substrate, the electrostatic cover is not supported by the switch substrate. The electrostatic cover is electrically connected to the second driving electrode, and is able to move within a range, predetermined by the bezel. Generally, the electrostatic cover is able to move comparatively freely since the electrostatic cover is not applied with pressure, and is not applied with a comparatively less pressure.

The electrostatic cover is not supported by the switch substrate, and may be substantially deformed by an elasticity of the electrostatic cover. The electrostatic cover may include a conductive layer, and the conductive layer may be electrically connected to the second driving electrode. Accordingly, an electrostatic force may be formed between the first driving electrode and the conductive layer, such that the electrostatic cover is elastically deformed so that a connection electrode may connect the input terminal and the output terminal. Since the electrostatic cover is not supported by a spring or an additional supporting device, the electrostatic cover may be deformed by a force greater than the electrostatic cover's own elasticity, and may perform a switching function even when a comparatively lower voltage is applied.

The connection electrode electrically connects the input terminal with the output terminal. The connection electrode is separated from the input terminal and the output terminal, and may connect the input terminal with the output terminal when the electrostatic cover is deformed. In addition, the connection electrode is connected to one of the input terminal and the output terminal, and may connect to the non-connected terminal when the electrostatic cover is deformed.

The bezel limits the movable area of the electrostatic cover, however the bezel may allow the electrostatic cover to move either freely or limitedly in the movable area. The bezel allows the electrostatic cover to be in a predetermined location on the switch substrate, and prevents the electrostatic cover from separating from the switch substrate beyond an influence of the electrostatic cover's electrostatic field. The electrostatic cover is not required to be separate from the switch substrate, and is not required to be reversed even when there is a severe wobbling with the switch substrate, and it is desirable that the electrostatic cover is electrically connected to the second driving electrode. The bezel may have a conductive structure or may be made of a conductive material, and may connect the second driving electrode with the conductive layer even when the switch substrate is reversed.

In addition, the electrostatic cover includes the conductive layer, which is electrically connected to the second driving electrode, and a first insulation layer which is formed on the conductive layer, and the conductive layer and the first insulation layer have different tensile or compressive residual stresses. Subsequently, at least two layers which configure the electrostatic cover have different direction features whose directions are opposite or whose strengths are different, and the electrostatic cover may be curvedly formed. As an example, the electrostatic cover may be convexly curved by using an upper layer having a compressive residual stress and a lower layer having a tensile residual stress, and the electrostatic cover may be convexly curved by using an upper layer having a greater compressive residual stress and a lower layer having a comparatively less compressive residual stress even when at least two layers have the compressive residual stress at the same time. Conversely, the electrostatic cover may be convexly curved by using an upper layer having a less tensile residual stress and a lower layer having a comparatively greater tensile residual stress. Furthermore, a degree of a curve of the electrostatic cover may be easily controlled by either forming upper and lower layers of the conductive layer having different types of residual stresses, or by forming upper and lower layers on a top and a bottom of the conductive layer have different strengths of residual stresses.

According to another aspect of the present invention, there is provided a micro switch device including: a switch substrate having an input terminal, an output terminal, a first driving electrode, and a second driving electrode; an electrostatic cover formed substantially in a dome shape physically separated from the switch substrate, and comprising a first insulation layer which faces the first driving electrode and a conductive layer formed on the first insulation layer electrically connected to the second driving electrode, wherein a connection electrode is formed on a bottom of the first insulation layer between the input terminal and the output terminal to electrically connect the input terminal and the output terminal; and a bezel circumferentially formed along the electrostatic cover, and spaced apart a predetermined space from a circumference of the electrostatic cover.

In addition, the electrostatic cover is formed in a dome shape or likeliness, and is separated from the switch substrate. The first insulation layer and the conductive layer are sequentially formed on the electrostatic cover, and the connection electrode is formed on a center of the bottom of the first insulation layer to simultaneously connect the input terminal and the output terminal.

The arc-shaped bezel is circumferentially formed along the electrostatic cover, and the second driving electrode is circumferentially formed along and underneath the bezel formed in an arc-shape. The input terminal and the output terminal are located within the second driving electrode, and the first driving electrode may be widely formed between second driving electrode, input terminal, and the output terminal.

The electrostatic cover further includes the second insulation layer which is formed on another surface of the conductive layer corresponding to the first insulation layer, and at least three layers may be formed in the electrostatic cover. The conductive layer has a tensile or a compressive residual stress, which is distinguished from the first insulation layer and the second insulation layer, subsequently the electrostatic cover naturally maintains the dome shape after manufacturing the electrostatic cover. When the electrostatic cover is formed in the at least three layers, the electrostatic cover is easily controlled to be deformed, subsequently stability and processibility may be improved.

According to still another aspect of the present invention, there is provided a micro switch device including: a switch substrate having an input terminal, an output terminal, a first driving electrode, and a second driving electrode; an electrostatic cover formed substantially in a dome shape to be physically separated from the switch substrate, and comprising a first insulation layer which faces the first driving electrode and a conductive layer formed on the first insulation layer to be electrically connected to the second driving electrode, wherein a connection electrode is formed on a bottom of the first insulation layer between the input terminal and the output terminal to electrically connect the input terminal and the output terminal; and a bezel circumferentially formed along the electrostatic cover, and spaced apart a predetermined space from a circumference of the electrostatic cover; and an electrode bridge electrically connecting either the input terminal or the output terminal to the connection electrode. According to an exemplary embodiment of the present invention, the connection electrode is electrically connected to one of the input terminal and the output terminal, and may be electrically connected to the non-connected terminal by an electrostatic force between the electrostatic cover and the first driving electrode.

According to yet another aspect of the present invention, there is provided a micro switch manufacturing method which includes: forming an input terminal, an output terminal, a first driving electrode, and a second driving electrode; forming a first sacrificial layer on the switch substrate; forming an electrostatic cover which has a connection electrode on the switch substrate on which the first sacrificial layer is formed; forming a second sacrificial layer on the electrostatic cover; forming a bezel in a circumference of the second sacrificial layer; and eliminating the first and second sacrificial layers. By eliminating the first and second sacrificial layers, the electrostatic cover may freely move in the bezel, and may operate within a movable range, predetermined by the bezel, at a lower power.

BRIEF DESCRIPTION OF THE DRAWINGS

The above and other aspects of the present invention will become apparent and more readily appreciated from the following detailed description of certain exemplary embodiments of the invention, taken in conjunction with the accompanying drawings of which:

FIG. 10 illustrates comparisons features according to configurations of layers of an electrostatic cover of the present invention;

DETAILED DESCRIPTION OF EXEMPLARY EMBODIMENTS OF THE INVENTION

Figure 1:
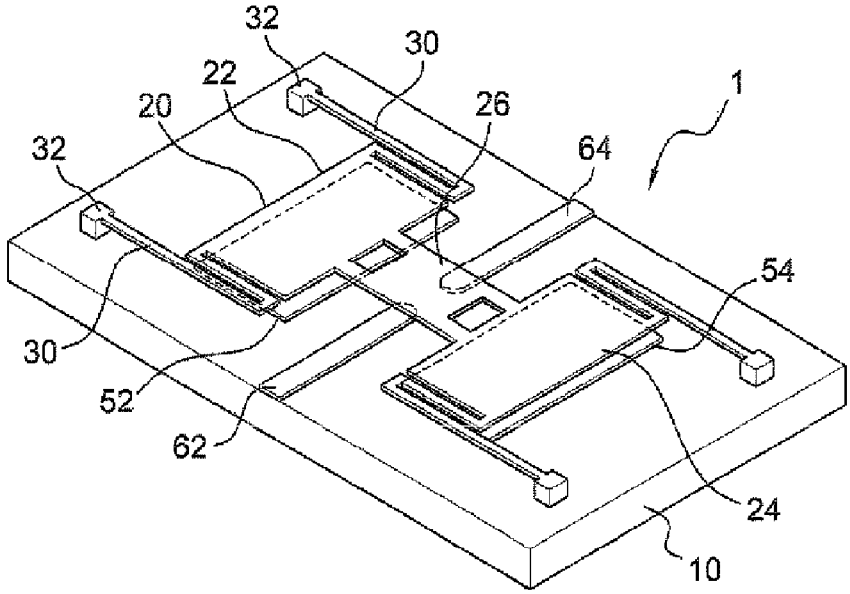
FIG. 1 (RELATED ART)
FIG. 1 is a perspective view illustrating a related art micro switch device.
Figure 2:
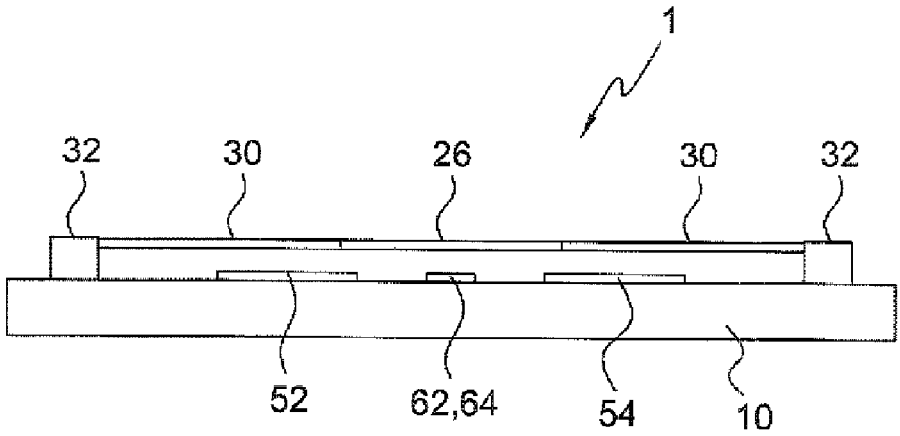
FIG. 2 (RELATED ART)
FIG. 2 is a front view illustrating the micro switch device of FIG. 1.

Reference will now be made in detail to exemplary embodiments of the present invention, examples of which are illustrated in the accompanying drawings, wherein like reference numerals refer to like elements. The exemplary embodiments are described below in order to explain the present invention by referring to the figures.

Figure 3:
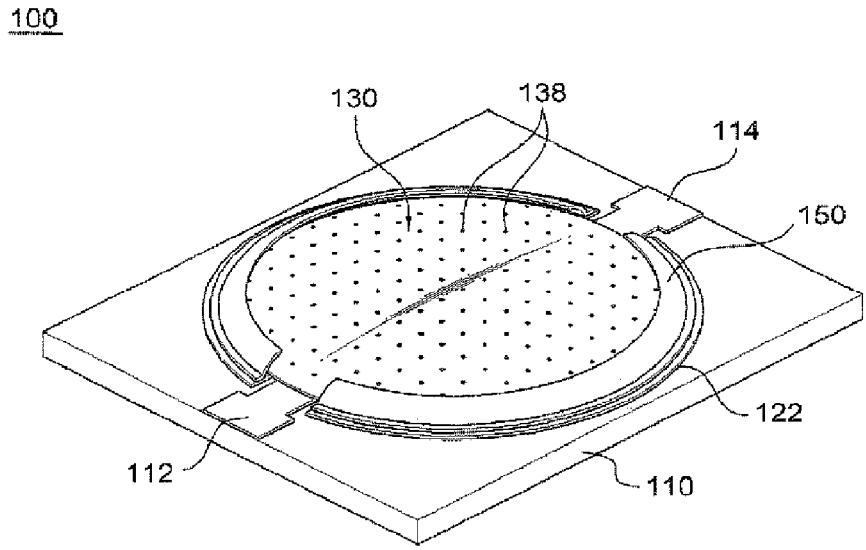
FIG. 3 is a perspective view illustrating a micro switch device according to an exemplary embodiment of the present invention.
Figure 4:
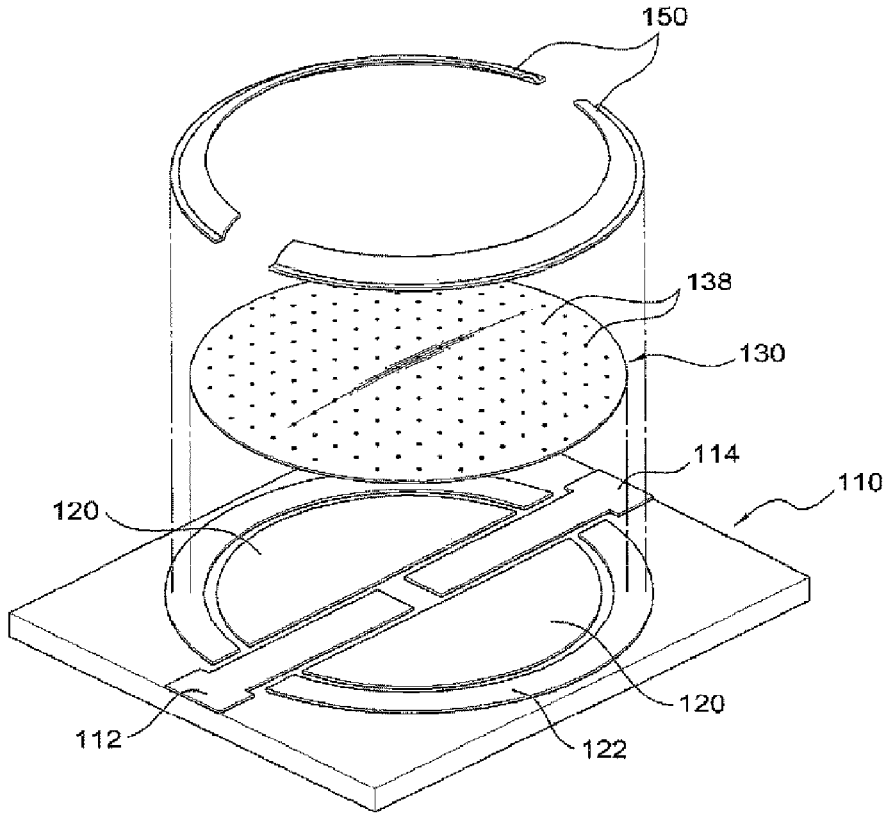
FIG. 4 is an exploded perspective view illustrating the micro switch device of FIG. 3.

FIG. 3 is a perspective view illustrating a micro switch device according to an exemplary embodiment of the present invention, and FIG. 4 is an exploded perspective view illustrating the micro switch device of FIG. 3.

Referring to FIGS. 3 and 4, the micro switch device 100 includes a substrate 110, an electrostatic cover 130, and a bezel 150. From a center of the micro switch device 100, an input terminal 112 and an output terminal 114 are located opposite from each other on the substrate 110, and a first driving electrode 120 and a second driving electrode 122 are sequentially formed from adjacent ends of the input terminal 112 and the output terminal 114. According to the exemplary embodiment the electrostatic cover 130 is shaped as a low dome, and the bezel 150 is formed in an arc shaped corresponding to a circumference of the electrostatic cover 130. The electrostatic cover 130 is physically separately provided on the substrate 110, and the circumference of the electrostatic cover 130 may be partially covered by the bezel 150.

A connection electrode (not illustrated) is included in a bottom of the electrostatic cover 130. The connection electrode is formed on a center of the bottom of the electrostatic cover 130, and electrically separated from an outside. When the electrode cover 130 is operated by the first driving electrode 120, the connection electrode electrically connects to the input terminal 112 and the output terminal 114 to connect the input terminal 112 with the output terminal 114. A plurality of micro holes 138 may be formed on the electrode cover 130, and a sacrificial layer may be easily eliminated through the plurality of micro holes 138. Due to the plurality of micro holes 138, an elasticity of the electrostatic cover 130 may be controlled.

Figure 5:
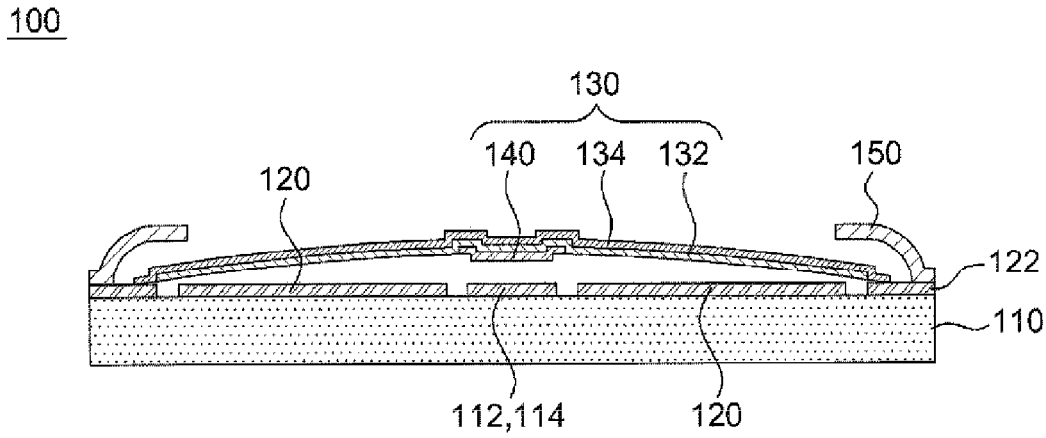
FIGS. 5 and 6 are cross-sectional views illustrating operation mechanisms when the micro switch device of FIG. 3 is in a normal location.
Figure 6:
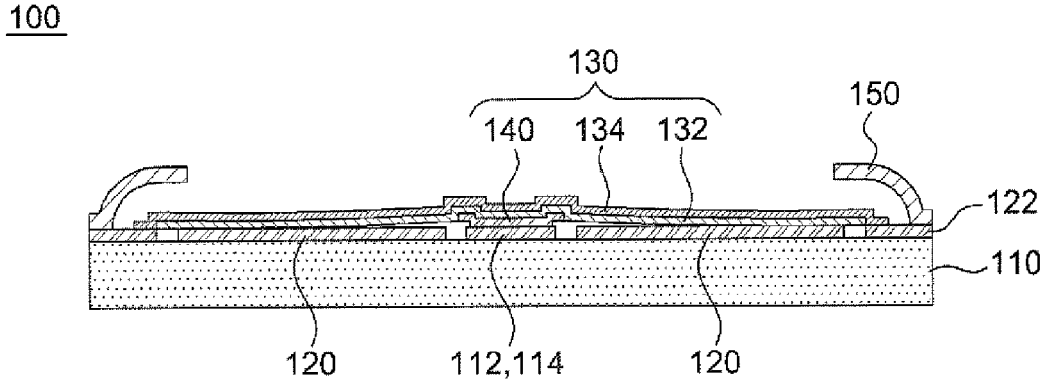

FIGS. 5 and 6 are cross-sectional views illustrating operation mechanisms when the micro switch device 100 of FIG. 3 is in a normal location. For reference, an inner configuration of the micro switch device 100 is more clearly illustrated in FIG. 5.

Referring to FIG. 5, the electrostatic cover 130 includes a first insulation layer 132 and a conductive layer 134, and a connection electrode 140 is located on a center of a bottom of the first insulation layer 132. The connection electrode 140 is formed to simultaneously contact an input terminal and an output terminal, and is electrically separated from the conductive layer 134. Conversely, the electrostatic cover 130 and the conductive layer 134 are formed in one body, or electrically connected with each other.

As illustrated, in the electrostatic cover 130, a circumference of the conductive layer 134 is contacted to the second driving electrode 122 to be electrically connected, and a power supplied to the second driving electrode 122 is supplied to the conductive layer 134 to generate an electrostatic force against the first driving electrode 120. For this, the circumference of the conductive layer 134 is required to be expanded to be larger than a circumference of the first insulation layer 132, and a diameter of the conductive layer 134 is greater than a diameter of the first insulation layer 132.

According to the exemplary embodiment, the electrostatic cover 130 is formed in a dome shape, and is horizontally circular from a surface. However, according to another embodiment of the present invention, an electrostatic cover may be formed in one of various shapes, of which a center portion is higher than a circumference, and another electrostatic cover, when viewed from above, may be formed in quadrangular or oval shape. Since an upper portion of the circumference of the electrostatic cover 130 is partially covered by the bezel 150, the electrostatic cover 130 may move in a horizontal direction or in a vertical direction within a movable range, limited by the bezel 150, and may freely move since the electrostatic cover 130 is un-pressed. In addition, the electrostatic cover 130 may not be separated from the substrate 110, and may be in a range where the conductive layer 134 and the second driving electrode 122 are always electrically connected with each other.

According to the exemplary embodiment, the bezel 150 is made of a conductive material or has a structure which can connect with the conductive layer 134 of the electrostatic cover 130. Namely, the bezel 150 may be made of a conductive material, or an inner configuration of the bezel 150 may be plated to have a conductive feature, and this will be described later.

Referring to FIG. 5, the electrostatic cover 130 may be protruded and curved, and the connection electrode 140 is electrically separated from both the input terminal 112 and the output terminal 114. The circumference of conductive layer 134 of the electrostatic cover 130 is formed wider than the circumference of the first insulation layer 132, and is electrically connected with the second driving electrode 122 when the electrostatic cover 130 is not reversed.

As illustrated, when approaching the circumference of the second driving electrode 122, a distance between the conductive layer 134 and the first driving electrode 120 becomes less. The electrostatic force around the circumference of the electrostatic cover 130 is greater than that of the center portion thereof at a same voltage difference. In addition, the electrostatic force around the circumference of the electrostatic cover 130 may be formed to be greater than that of parallel separated electrodes in a related art as can be seen in the electrodes 22, 24, 52 and 54 in FIG. 1.

Accordingly, the electrostatic cover 130 is physically separated from the substrate 110, and the electrostatic cover 130 may operate at a comparatively lower driving voltage since the conductive layer 134 is curvedly formed.

Referring to FIG. 6, as a voltage difference between the first driving electrode 120 and the second driving electrode 122 increases, the electrostatic cover 130 becomes close to the substrate 110 when the voltage difference is greater than a predetermined voltage difference. In this instance, the connection electrode 140 may electrically connect to the input terminal 112 and the output terminal 114, and the electrostatic cover 130 may be contacted to the substrate while the predetermined voltage difference is maintained.

When the voltage difference between the first driving electrode 120 and the second driving electrode 122 decreases, a restoring force of the electrostatic cover 130 is greater than the electrostatic force when the voltage difference is less than a predetermined voltage difference, subsequently the electrostatic cover 130 may be restored to be curvedly protruding.

Figure 7:
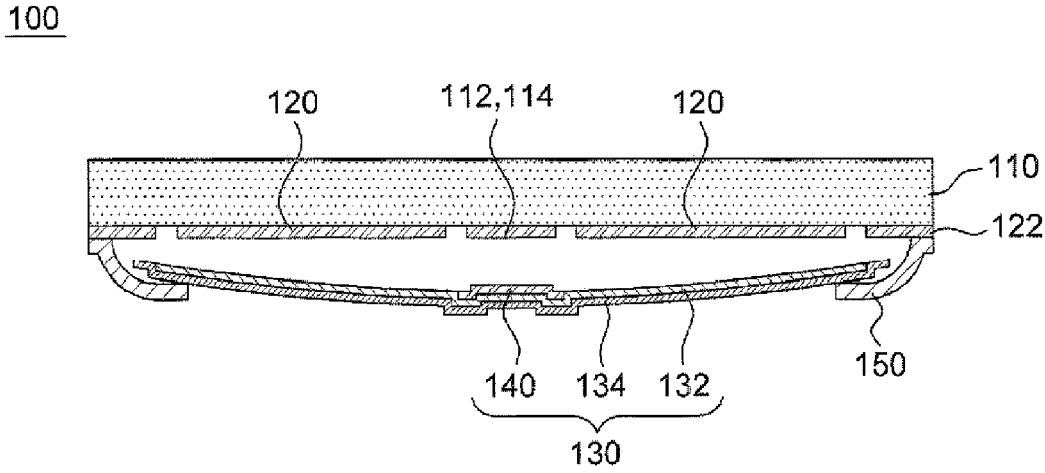
FIGS. 7 and 8 are cross-sectional views illustrating an operation mechanism when the micro switch device of FIG. 3 is reversed.
Figure 8:
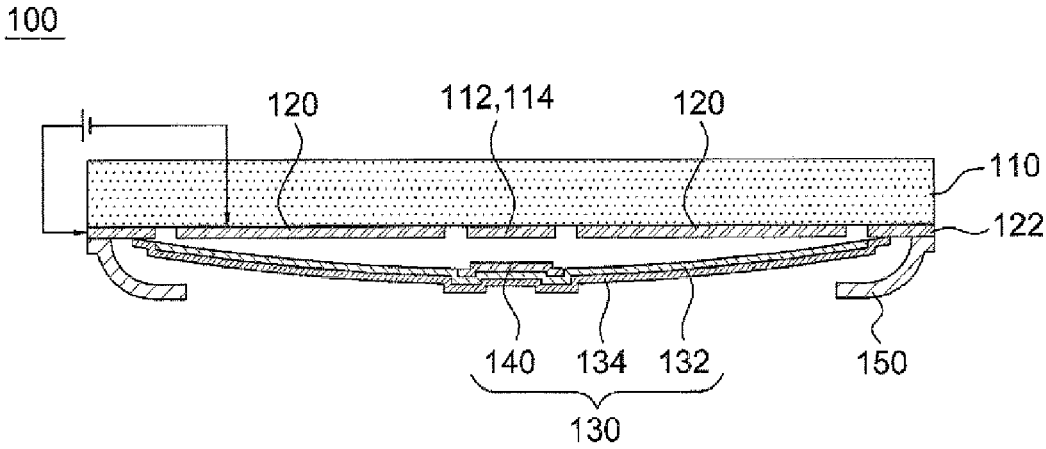

FIGS. 7 and 8 are cross-sectional views illustrating an operation mechanism when the micro switch device 100 of FIG. 3 is reversed.

Referring to FIG. 7, an electrostatic cover 130 is supported by a bezel 150 when a micro switch device 100 is reversed. In this instance, even when a conductive layer 134 of the electrostatic cover 130 is separated from a second driving electrode 122, the conductive layer 134 of the electrostatic cover 130 may be electrically connected with the second driving electrode 122 since the bezel 150 is electrically connected. As described above, since the bezel 150 is made of the conductive material or has a structure which can connect with the conductive layer 134 of the electrostatic cover 130, a circumference of the conductive layer 134 of the electrostatic cover 130 is electrically connected with the second driving electrode 122 via the bezel 150, and a voltage supplied to the second driving electrode 122 is supplied to the conductive layer 134 to generated an electrostatic force against a first driving electrode 120.

Referring to FIG. 8, as a voltage difference between the first driving electrode 120 and the second driving electrode 122 increases, the electrostatic cover 130 may contact a substrate 110 by an electrostatic force. This is because a voltage is supplied to the conductive layer 134 via the bezel 150.

Conversely, when the voltage difference between the first driving electrode 120 and the second driving electrode 122 decreases, a restoring force of the electrostatic cover 130 is greater than the electrostatic force when the voltage difference is less than a predetermined voltage difference, subsequently the electrostatic cover 130 may be restored to be curved by gravity.

FIGS. 9A through 9H are cross-sectional views illustrating a manufacturing method of the micro switch device of FIG. 3.

Figure 9A:
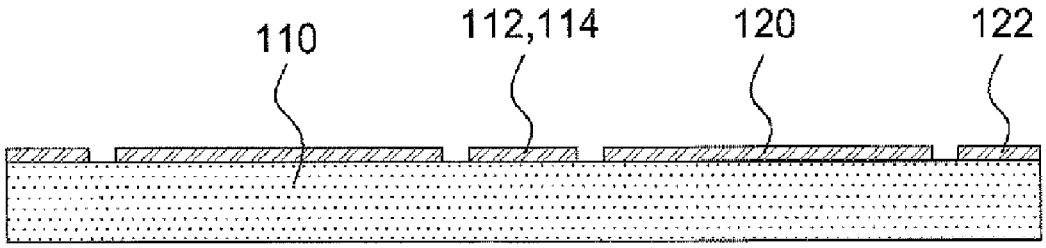
FIGS. 9A through 9H are cross-sectional views illustrating a manufacturing method of the micro switch device of FIG. 3.

Referring to FIG. 9A, an input terminal 112, an output terminal 114, a first driving electrode 120, and a second driving electrode 122 are formed on a high resistance substrate 110. Structures of the input terminal 112, the output terminal 114, the first driving electrode 120, and the second driving electrode 122 may correspond to the structures of the input terminal 112, the output terminal 114, the first driving electrode 120, and the second driving electrode 122 of FIG. 4, a thin film made of Au is formed on the substrate 110 to form the input terminal 112, the output terminal 114, the first driving electrode 120, and the second driving electrode 122, and a required pattern may be formed via a pre-process of etching. Since it is clear for one skilled in the art to form the thin film and the pattern, the process for the thin film and the pattern will be omitted in the exemplary embodiment discussed herein.

Figure 9B:
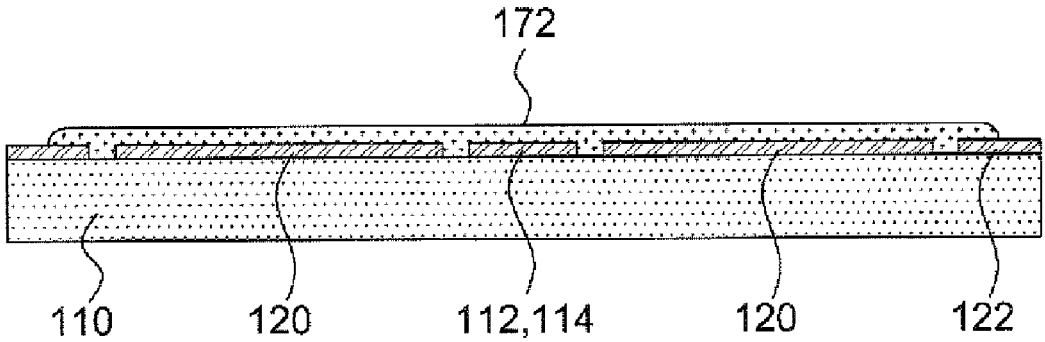

Referring to FIG. 9B, a first sacrificial layer 172 is formed on the substrate 110 where the input terminal 112, the output terminal 114, the first driving electrode 120, and the second driving electrode 122 are formed. In this instance, the sacrificial layer may partially expose the second driving electrode 122 to form the bezel 150, or the second driving electrode 122 may be exposed by partially eliminating the first sacrificial layer 172 after entirely forming the first sacrificial layer 172.

Figure 9C:
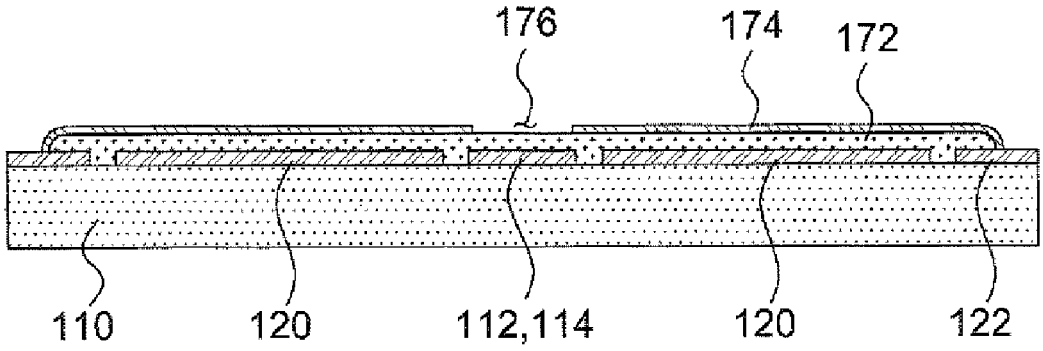

Referring to FIG. 9C, a third sacrificial layer 174 is formed on the first sacrificial layer 172 to form the connection electrode 140. The third sacrificial layer 174 includes a hole 176 corresponding to the input terminal 112 and the output terminal 114, and a top of the first sacrificial layer 172 is partially exposed by the hole 176.

Figure 9D:
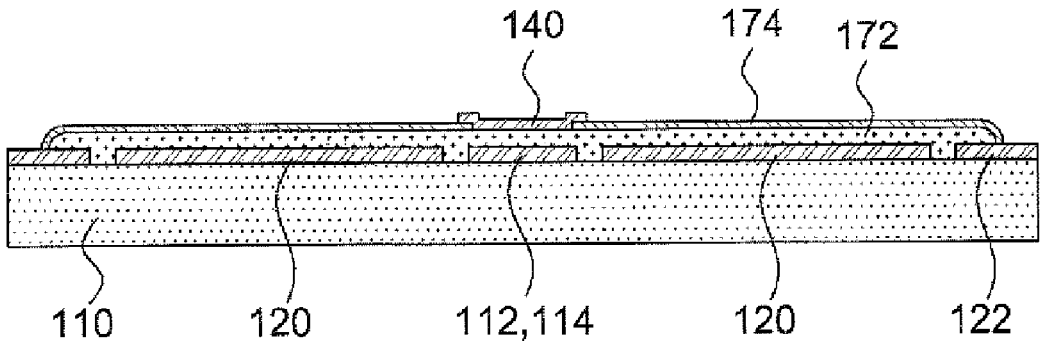

Referring to FIG. 9D, the connection electrode is formed corresponding to the hole 176 of the third sacrificial layer 174. The connection layer 140 is made of a conductive metal.

Figure 9E:
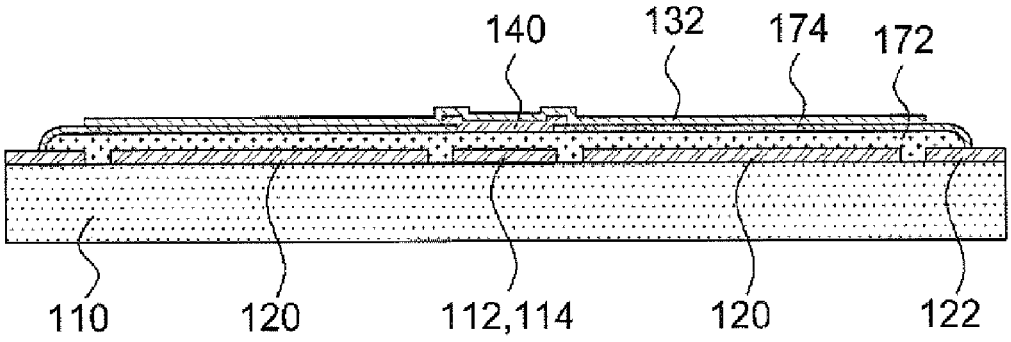

Referring to FIG. 9E, a first insulation layer 132 is formed on the substrate 110 where the connection layer 140 is formed. The insulation layer 132 is formed using an insulating material on the first sacrificial layer 173 and third sacrificial layer 174, and is separated from the second driving electrode 122.

Figure 9F:
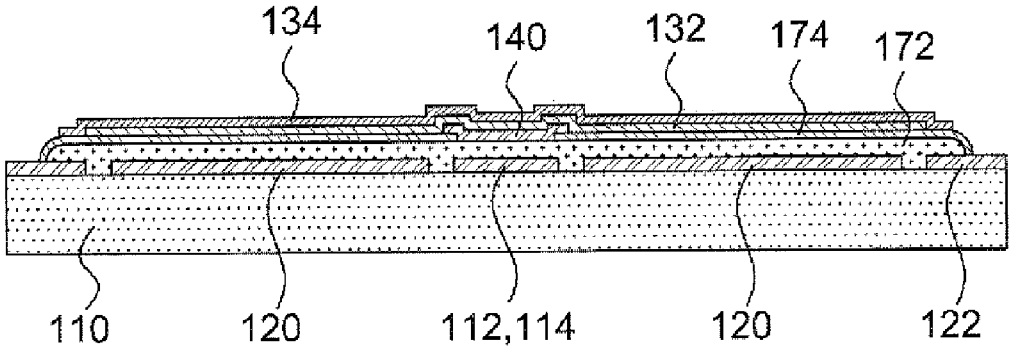

Referring to FIG. 9F, the conductive layer 134 is formed on the first insulation layer 132. The conductive layer 134 is formed to be wider than the first insulation layer 132, and a diameter of the conductive layer 134 is greater than a diameter of the first insulation layer 132. In addition, the diameters of the first insulation layer 132 and the conductive layer 134 may be required to be large enough so that the first insulation layer 132 and the conductive layer 134 may be decreased as the first insulation layer 132 and the conductive layer 134 may be convexly curved later. The conductive layer 134 is required to be spaced apart from the exposed second driving electrode 122.

Since the conductive layer 134 is formed to be wider than the first insulation layer 132, a circumference of the conductive layer 134 may be exposed to an outside of the first insulation layer 132, and the conductive layer 134 may be electrically connected with the second driving electrode 122.

Figure 9G:
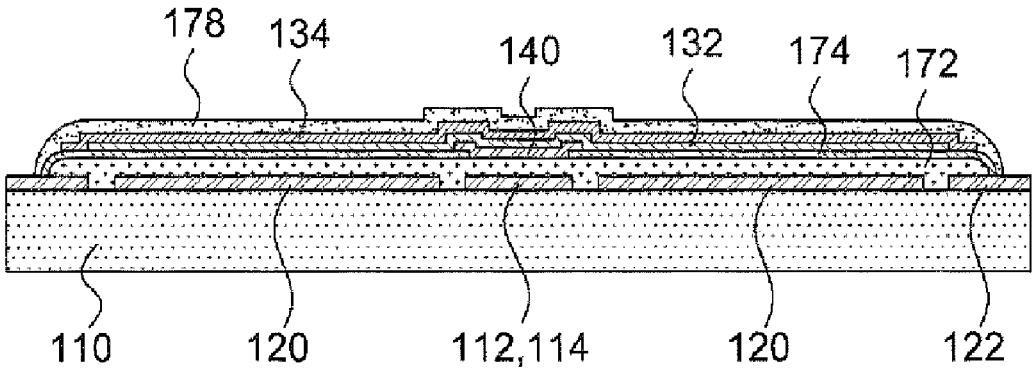

Referring to FIG. 9G, the second sacrificial layer 178 is formed on the conductive layer 134 to cover the conductive layer 134. In this instance, an outside of the second driving electrode 122 is required to be exposed even when the second sacrificial layer 178 covers the conductive layer 134.

Figure 9H:
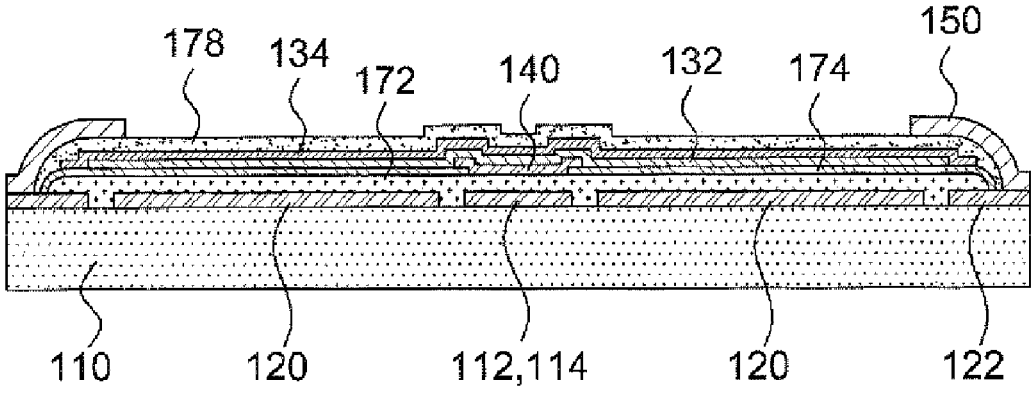

Referring to FIG. 9H, the bezel 150 is formed on a circumference of the second sacrificial layer 178. The bezel 150 is made of a metal material, and is circumferentially formed in an arc type along the second sacrificial layer 178. The bezel 150 is formed in a dome shape, exposing a center thereof.

As illustrated in FIG. 5, the manufacturing of the micro switch device 100 is completed by eliminating both the first sacrificial layer 174 and the third sacrificial layer 176. The first sacrificial layer 174 and the third sacrificial layer 176 may be eliminated via a dry etching which uses a dry ashing or a wet etching which uses an eliminating solution. A silicon nitride (SiN) and a silicon oxide (SiOx) are generally used for the sacrificial layers, and the eliminating solution may be selectively used depending on a corresponding material of the sacrificial layers. In addition, the sacrificial layers may be made of photoresist or parylene, and may be eliminated via an ashing process which uses oxygen plasma.

In addition, as illustrated in FIGS. 3 and 4, the plurality of micro holes 138 may be formed on the electrostatic cover 130 to easily eliminate the sacrificial layers. The eliminating solution may easily penetrate to meet the sacrificial layers, and a solution which melts the sacrificial layers, may easily pass through the plurality of micro holes 138.

When the sacrificial layers 172, 174 and 178 are eliminated, the electrostatic cover 130 may become convexly curved due to a difference of residual stresses between the conductive layer 134 and the first insulation layer 132. FIG. 10 illustrates comparisons features according to structures of layers of an electrostatic cover of the present invention, and the electrostatic cover may be variously formed in structures having at least two layers by applying a different residual stress.

As an example, in case 1 of FIG. 10, an upper layer of the electrostatic cover may have a greater compressive residual stress, and a lower layer of the electrostatic cover may have a comparatively lower compressive residual stress. In this case, the electrostatic cover may be formed in a curvedly protruding shape, however controllability is comparatively lower, and stability and processibility are comparatively lower.

As another example, in case 2, an upper layer of the electrostatic cover may have a compressive residual stress, and a lower layer of the electrostatic cover may have a tensile residual stress. In this case, controllability is greater than the case 1, and stability and processibility are slightly improved.

As still another example, in case 3, an upper layer of the electrostatic cover may have a lower tensile residual stress, and a lower layer of the electrostatic cover may have a comparatively greater compressive residual stress. In this case, controllability, stability, and processibility are comparatively improved over the cases 1 and 2.

As yet another example, the electrostatic cover may be formed to have three layers. In case 4, a middle layer of the electrostatic cover may have a greater tensile residual stress, and an upper layer and a lower layer of the electrostatic cover may have a comparatively less tensile residual stress. In this case, better controllability, stability, and processibility are entirely achieved when compared with the previous cases 1, 2, and 3. When the electrostatic cover is formed to have two layers, there may be great influential changes of the compressive stresses or thicknesses of the upper layer and the lower layer of the electrostatic cover. However, when the electrostatic cover is formed to have three layers, a regular/even curve may be expected, and excellent controllability, stability, and processibility are expected since the changes of the compressive stresses or thicknesses of the upper layer and the lower layer of the electrostatic cover are complemented by the upper layer and the lower layer. Accordingly, it is more desirable to form three layers having different compressive residual stresses than to form two layers.

Figure 11:
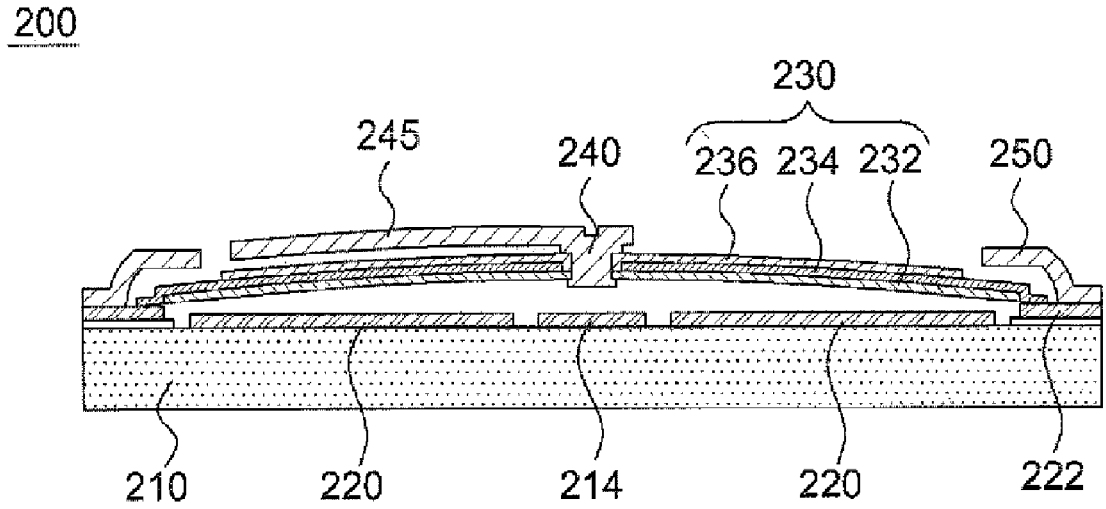
FIG. 11 is a cross-sectional view illustrating a micro switch device according to another exemplary embodiment of the present invention.
Figure 12:
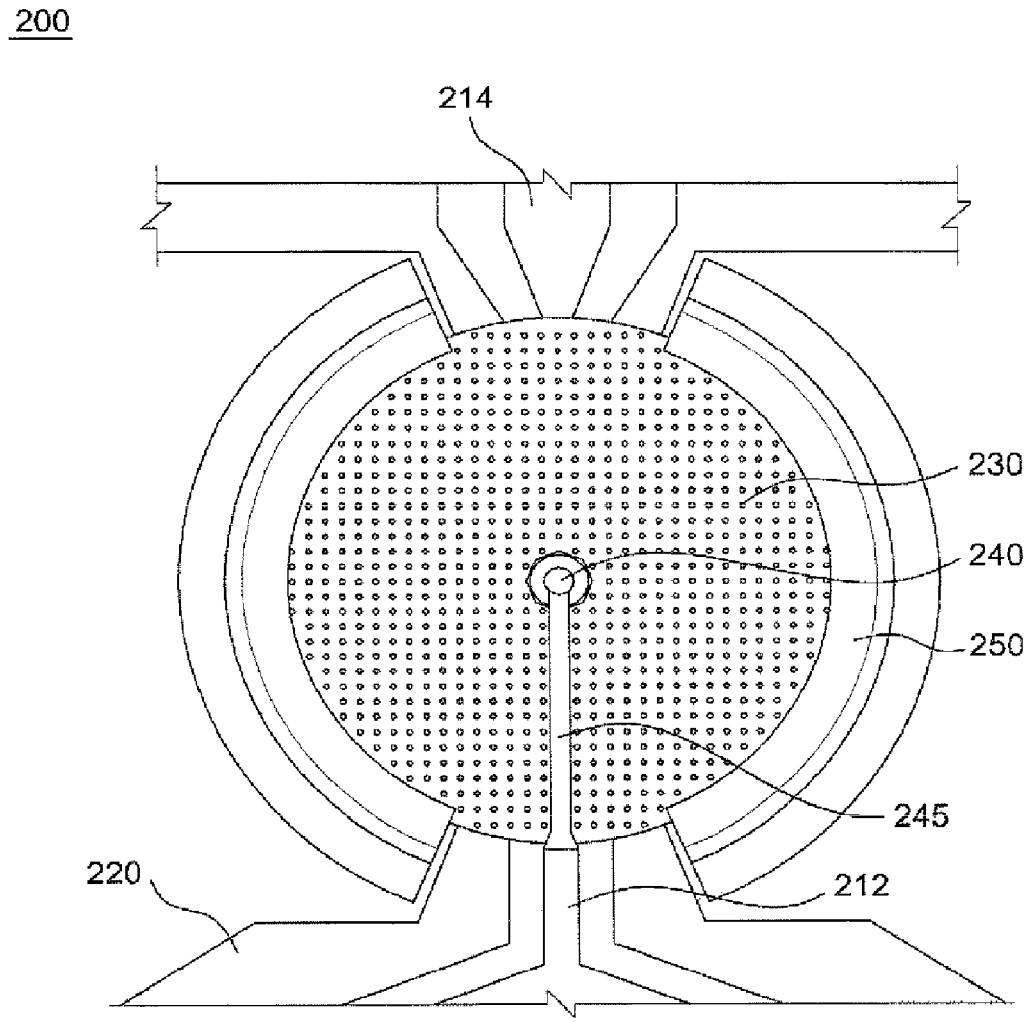
FIG. 12 is a top view illustrating the micro switch device of FIG. 11.
Figure 13:
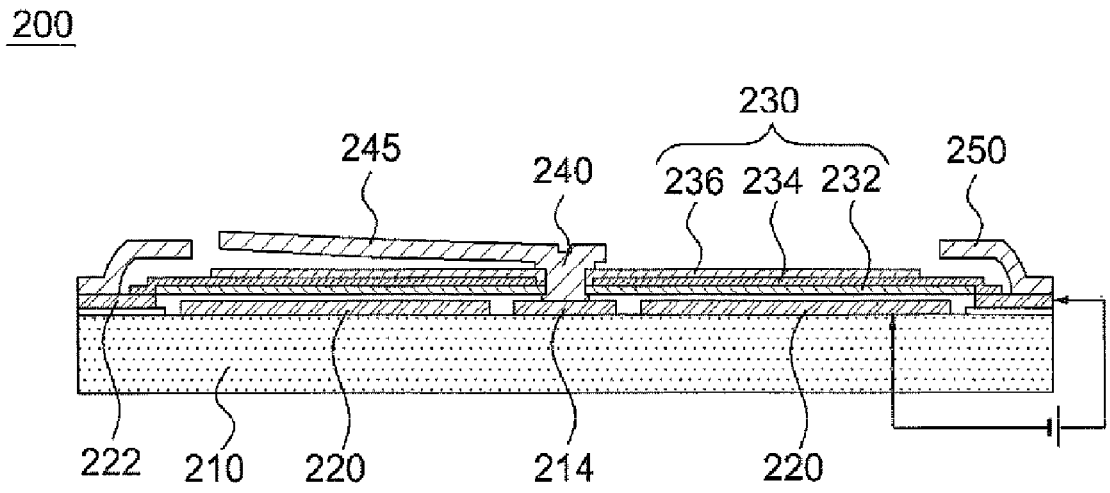
FIG. 13 is a cross-sectional view illustrating that an electrostatic cover of the micro switch device of FIG. 11 is contacted on a substrate.

FIG. 11 is a cross-sectional view illustrating a micro switch device 200 according to another exemplary embodiment of the present invention, FIG. 12 is a top view illustrating the micro switch device 200 of FIG. 11, and FIG. 13 is a cross-sectional view illustrating that an electrostatic cover 230 of the micro switch device 200 of FIG. 11 is contacted on the substrate 210.

Referring to FIGS. 11 and 12, the micro switch device 200 includes a substrate 210, an electrostatic cover 220, a bezel 250, and an electrode bridge 245.

An output terminal 214 is formed on the substrate 210, on a center of the micro switch device 200. An input terminal 212 is formed on a circumference of the micro switch device 200, and an end of the input terminal 212 is located on a circumference of an arc where a second driving electrode 222 is formed. A first driving electrode 220 and the second driving electrode 222 are sequentially formed from a center of an end of the output terminal 214, and the end of the input terminal 212 is closely located on the second driving electrode 222.

For reference, the electrode bridge 245 is located as illustrated in FIG. 12, and connected with the input terminal 212 which is connected to an outside. While location of the electrode bridge 245 in FIGS. 11 through 13 seems to be unusual, this is only to effectively illustrate the cross-sectional view of the micro switch device 200 according to the embodiment of the present invention.

Since the electrostatic cover 230 is formed in a low dome shape, the bezel 250 is formed in an arc type corresponding to a circumference of the electrostatic cover 230, and shapes of the first driving electrode 220, the second driving electrode 222, and the bezel 250 of FIG. 11 correspond to the shapes of the first driving electrode 120 and the second driving electrode 122, and the bezel 150 in FIG. 4.

The electrostatic cover 230 is physically separated from the substrate 210, a circumference of the substrate 230 is partially covered by the bezel 250. The electrostatic cover 230 includes a connection electrode 240 on a center thereof, and the connection electrode 240 is electrically connected with the input terminal 212 via the electrode bridge 245. The electrode bridge 245 is mainly to electrically connect the connection electrode 240 with the input terminal 212, and a physical influence with respect to the electrostatic cover 230 is required to be minimized.

When the electrostatic cover 230 operates by the first driving electrode 220, the connection electrode 240, which is connected with the input terminal 212, electrically contacts with the output terminal 214, and consequently the output terminal 214 is connected with the input terminal 212. A plurality of holes are formed on the electrostatic cover 230, may be used to eliminate sacrificial layers described below.

Referring to FIG. 11, the electrostatic cover 230 includes a first insulation layer 232, a conductive layer 234, and a second insulation layer 236. As the case 4 illustrated in FIG. 10, the conductive layer 234 is made of an aluminum material, and has a comparatively greater tensile residual stress. The first insulation layer 232 and the second insulation layer 236 are made of a silicon nitride film or a silicon oxide film, which are formed via low temperature Plasma Enhanced Chemical Vapor Deposition (PECVD), subsequently may have a less tensile residual stress. Accordingly, after eliminating sacrificial layers, a stable dome shape is formed due to excellent controllability and processibility.

A circumference of the conductive layer 234 of the electrostatic cover 230 is contacted to the second driving electrode 222 to electrically connect to the second driving electrode 222, and a voltage supplied to the second driving electrode 222 is supplied to the conductive layer 234 to generate an electrostatic force with the first driving electrode 220. For this, the circumference of the conductive layer 234 is formed wider than circumferences of the first insulation layer 232 and the second insulation layer 234, and a diameter of the conductive layer 234 is greater than the diameters of the first insulation layer 232 and the second insulation layer 234.

Since an upper portion of a circumference of the electrostatic cover 230 is partially covered by the bezel 250, the electrostatic cover 230 may move in a horizontal direction or in a vertical direction within a movable range, limited by the bezel 250. In addition, the electrostatic cover 230 may not be separated from the substrate 210, and may be in a range where the conductive layer 234 and the second driving electrode 222 are always electrically connected with each other.

The bezel 250 is made of a conductive material which connects with the conductive layer 234 of the electrostatic cover 230, and may be made of a metal material. In addition, when approaching a circumference of the second driving electrode 222, a distance between the conductive layer 234 and the first driving electrode 220 becomes less. The electrostatic force against the first driving electrode 220 around the circumference of the electrostatic cover 230 may be formed to be greater than an electrostatic force of a center of the electrostatic cover 230.

Referring to FIG. 13, as a voltage difference between the first driving electrode 220 and the second driving electrode 222 increases, the electrostatic cover 130 becomes close to the substrate 210, and subsequently the connection electrode 240 is contacted with the output terminal 214. Conversely, when the voltage difference between the first driving electrode 220 and the second driving electrode 222 decreases, a restoring force of the electrostatic cover 230 is greater than the electrostatic force, subsequently the electrostatic cover 230 may be restored to be curvedly protruding.

FIG. 14A through 14G are cross-sectional views illustrating a manufacturing method of the micro switch device of FIG. 11.

Figure 14A:
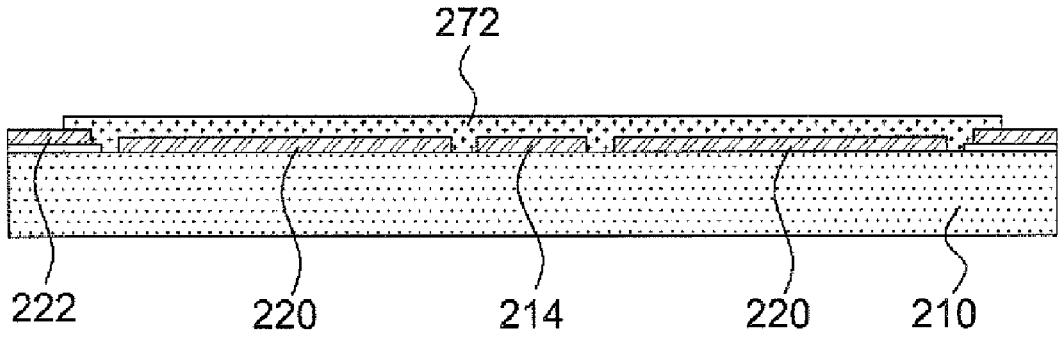
FIG. 14A through 14G are cross-sectional views illustrating a manufacturing method of the micro switch device of FIG. 11.

Referring to FIG. 14A, an input terminal 212, an output terminal 214, a first driving electrode 220, and a second driving electrode 222 are formed on a high resistance substrate 210, structures of the input terminal 212, the output terminal 214, the first driving electrode 220, and the second driving electrode 222 may correspond to the structures of the input terminal 112, the output terminal 114, the first driving electrode 120, and the second driving electrode 122 of FIG. 4. In addition, a first sacrificial layer 272 is formed on the substrate 210 where the input terminal 212, the output terminal 214, the first driving electrode 220, and the second driving electrode 222 are formed.

Figure 14B:
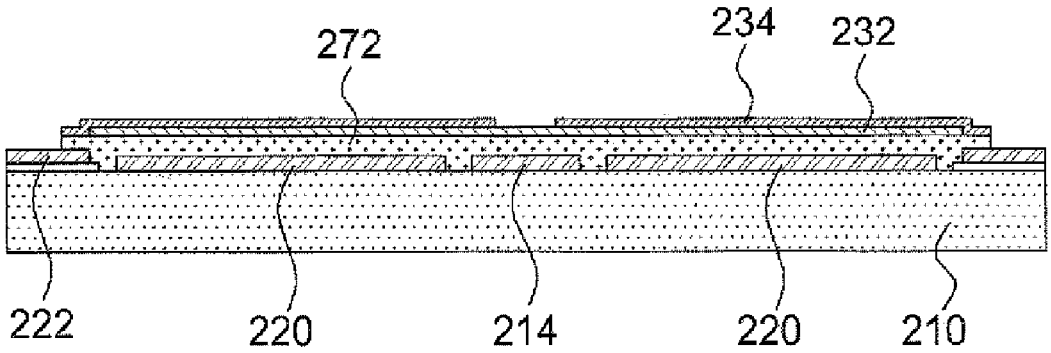
Figure 14C:
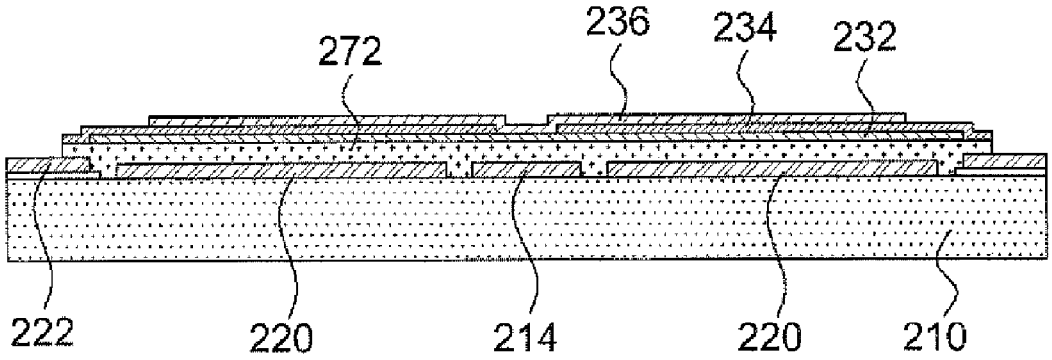

Referring to FIGS. 14B and 14C, a first insulation layer 232 and a conductive layer 234 are formed on the first sacrificial layer 272, and a second insulation layer 236 is formed on thereon. In this instance, the first sacrificial layer 272 may expose an outside of the second driving electrode 222, while partially covering an inside of the second driving electrode 222 to form a bezel. A center of the conductive layer 234 may include a plurality of holes corresponding to a connection electrode. In addition, the first insulation layer 232 and the second insulation layer 236 may be made of a silicon nitride (SiN) or a silicon oxide (SiOx), and both of the insulation layers may be made of a same material or different material. In this instance, the first insulation layer 232 and the second insulation layer 236 may be formed to a thickness of approximately 4000 to 4500 Å.

The first insulation layer 232 and the second insulation layer 236, a PECVD process may be used to form the first sacrificial layer 272, and a reactive ion etching (RIE) process may be used to pattern the conductive layer 234.

The conductive layer 234 is formed wider than circumferences of the first insulation layer 232 and the second insulation layer 234, and a diameter of the conductive layer 234 is greater than an inner diameter of the second driving electrode 222. In addition, the diameter the conductive layer 234 may be formed to be large enough by considering a fact that the diameter the conductive layer 234 may be decreased as the conductive layer 234 becomes protruded and curved later. Since the conductive layer 234 is formed wider than the first insulation layer 232 and the second insulation layer 236, the circumference of the conductive layer 234 may be exposed to an outside of the first insulation layer 232 and the second insulation layer 236, and the conductive layer 234 may be electrically connected with either the second driving electrode 222 or the bezel even when the conductive layer 234 is reversed.

Figure 14D:
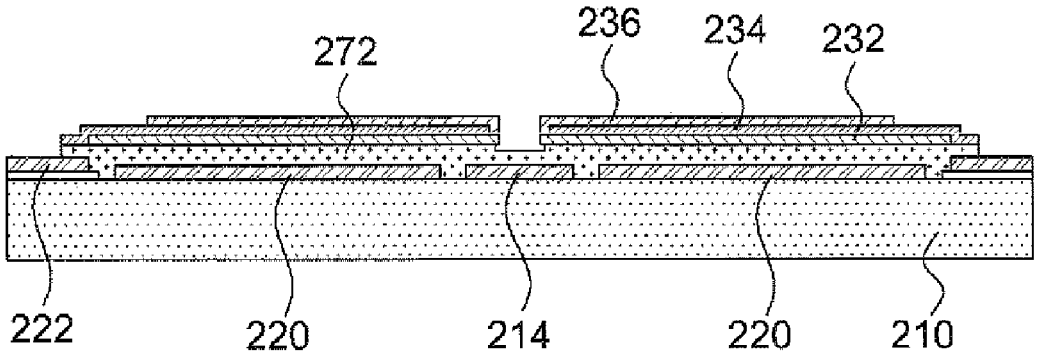

Referring to FIG. 14D, centers of the first insulation layer 232 and the second insulation layer 236 corresponding to the connection electrode may be etched until the first sacrificial layer 272 is exposed. After forming a mask pattern via a pre-process of etching, the first insulation layer 232 and the second insulation layer 236 may be etched via the RIE process to not expose an inner lateral surface of the conductive layer 234.

Figure 14E:
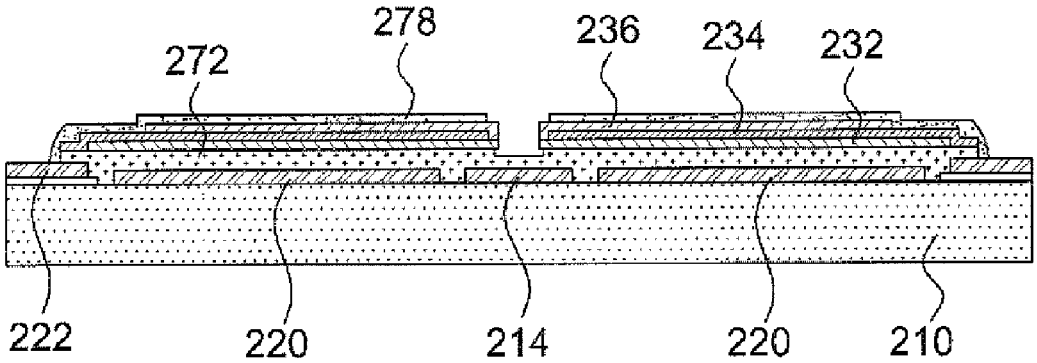

Referring to FIG. 14E, a second sacrificial layer 278 is formed on the second insulation layer 236 to cover the second insulation layer 236. In this instance, an outside of the second driving electrode 222 is required to be exposed by the second sacrificial layer 278, and the second sacrificial layer 278 is required to be eliminated in a center hole to form the connection electrode 240. The second sacrificial layer 278 may selectively be formed through deposition by the mask pattern, and may be formed via an etching process after a sputtering process.

Figure 14F:
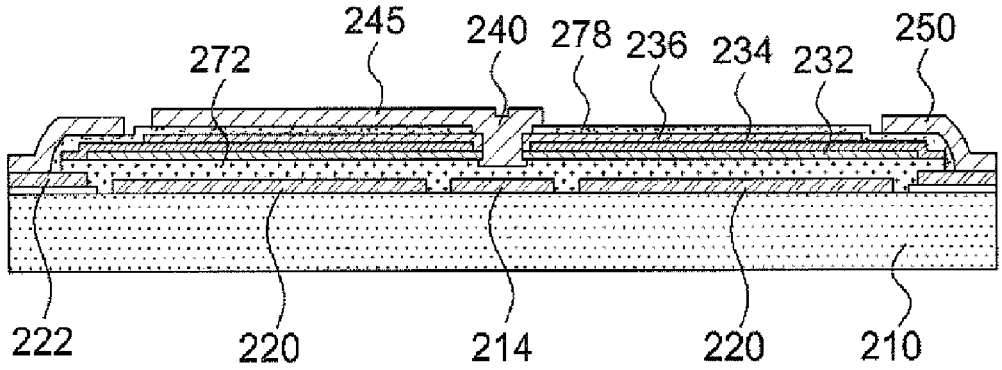

Referring to FIG. 14F, the bezel 250, the connection layer 240, and an electrode bridge 245 are formed on the substrate 210 after forming the second sacrificial layer 278. The bezel 250, the connection layer 240, and the electrode bridge 245 may be either sequentially formed, or formed at the same time. According to the exemplary embodiment, the bezel 250, the connection layer 240, and the electrode bridge 245 may be made of a metal material, and may be formed at a thickness of 1.7 μm when Au is used for the material.

Figure 14G:
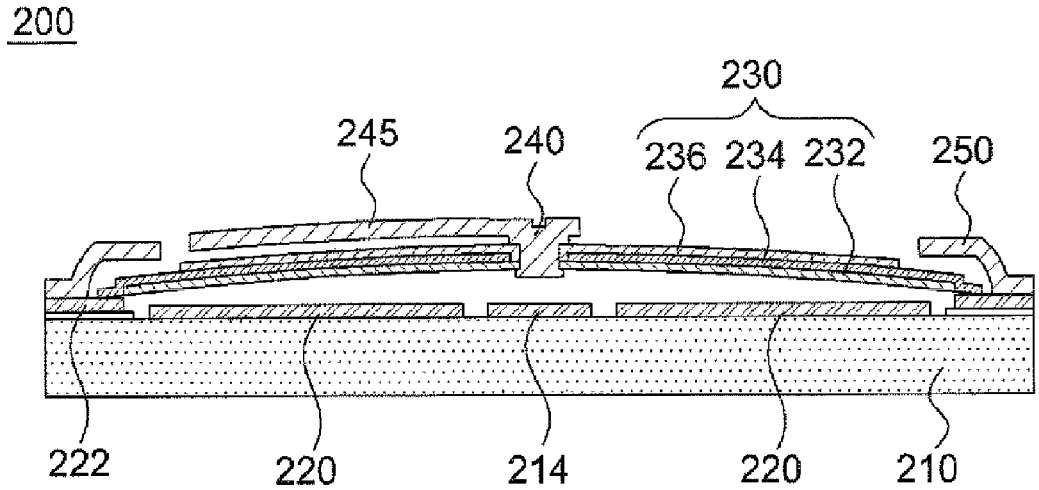

Referring to FIG. 14G, the first sacrificial layer 272 and the second sacrificial layer 278 are eliminated. An eliminating solution may be used to eliminate the first sacrificial layer 272 and the second sacrificial layer 278, and the first sacrificial layer 272 and the second sacrificial layer 278 may be eliminated via a wet etching process by using the eliminating solution.

As described above, a plurality of micro holes may be formed on the electrostatic cover 230 to easily eliminate the first sacrificial layer 272 and the second sacrificial layer 278. The eliminating solution may easily penetrate to the first sacrificial layer 272, and a solution which melts the sacrificial layers, may easily pass through the plurality of micro holes.

When the first sacrificial layer 272 and the second sacrificial layer 278 are eliminated, the electrostatic cover 230 may become curvedly protruding due to a difference of a residual stresses between the first insulation layer 232 and the second insulation layer 236, and the electrostatic cover 230 may be spaced apart from the substrate 210 and the bezel 250 by the first sacrificial layer 272 and the second sacrificial layer 278. Structures of layers of the electrostatic cover 230 may correspond to the descriptions of FIG. 10.

Figure 15:
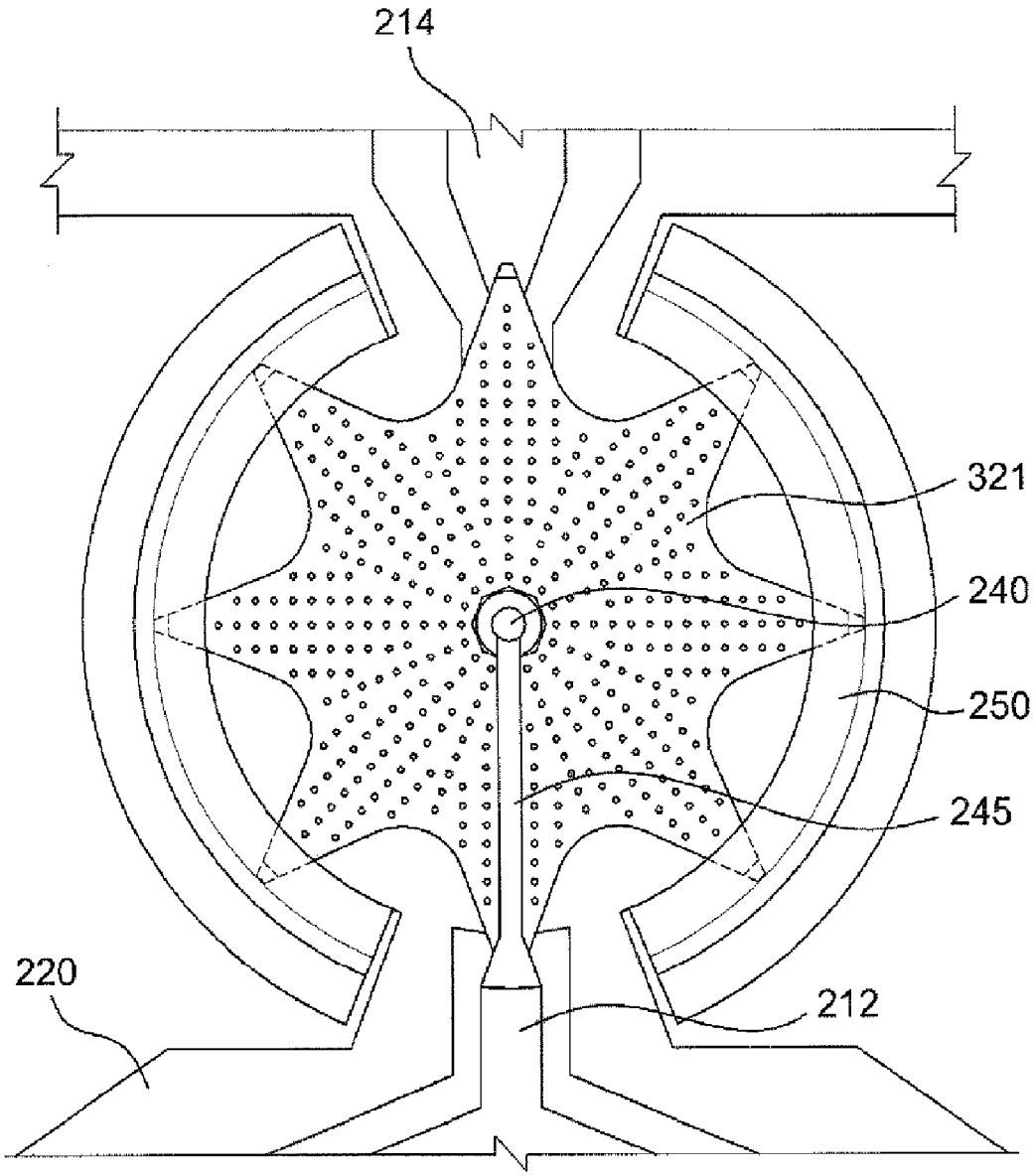
FIG. 15 is a top view illustrating a micro switch device according to still another exemplary embodiment of the present invention.

FIG. 15 is a top view illustrating a micro switch device according to still another exemplary embodiment of the present invention.

Referring to FIG. 15, an electrostatic cover 321 of the micro switch device may be formed in a star shape, and may be formed in various shapes having a plurality of branches. Further, the electrostatic cover 321 may be formed in various shapes on the condition that the electrostatic cover 321 is defined by a bezel.

According to the present invention, a micro switch device can be easily deformed a stage or a membrane since an electrostatic cover of the micro switch device is either not supported or is not affected by external influences, and a comparatively lower power is used to deform the electrostatic cover.

Additionally, according to a micro switch device of the present invention, a strong electrostatic force may be generated from a circumference of an electrostatic cover, and reliability with respect to operation may be improved since either a dome type electrostatic cover or a curved electrostatic cover maintains a close distance from a driving electrode at a circumference of the electrostatic cover.

In addition, according to a micro switch device of the present invention, a conductive layer and a second driving electrode are always connected with each other on the condition that a bezel limits a movable range of an electrostatic cover, and the conductive layer and the second driving electrode may be connected with each other via the bezel even when a substrate is reversed.

Further, according to a micro switch device of the present invention, processibility may be improved since the micro switch device is comparatively less influenced by a distance between a bezel and an electrostatic cover. Namely, the present invention is less influenced by a distance between electrodes where an electrostatic force is applied, and is comparatively less influenced by a manufacturing process, such as manufacturing precision or manufacturing skill.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A micro switch device comprising:

a switch substrate having an input terminal, an output terminal, a first driving electrode, and a second driving electrode;

an electrostatic cover physically separated from the switch substrate, electrically connected to the second driving electrode to be capable of forming an electrostatic force against the first driving electrode, and having a connection electrode to electrically connect the input terminal with the output terminal; and a bezel allowing the electrostatic cover to move while limiting a movable area of the electrostatic cover.

2. The micro switch device of claim 1, wherein the bezel limits the movable area of the electrostatic cover while the electrostatic cover is un-pressed.

3. The micro switch device of claim 1, wherein the bezel is capable of electrically connecting the electrostatic cover with the second driving electrode.

4. The micro switch device of claim 1, wherein the electrostatic cover is curvedly formed.

5. The micro switch device of claim 4, wherein the electrostatic cover comprises a conductive layer capable of being electrically connected to the second driving electrode and a first insulation layer formed on one surface of the conductive layer, wherein the conductive layer and the first insulation layer have different residual stresses.

6. The micro switch device of claim 5, wherein the electrostatic cover comprises the second insulation layer which is formed on another surface of the conductive layer corresponding to the first insulation layer.

7. The micro switch device of claim 6, wherein the conductive layer has one of a tensile and a compressive residual stress, wherein the conductive layer residual stress is different from the first insulation layer residual stress and the second insulation layer residual stress.

8. The micro switch device of claim 1, wherein the bezel is circumferentially formed along the electrostatic cover, and is spaced apart a predetermined distance from a circumference of the electrostatic cover.

9. The micro switch device of claim 1, wherein the electrostatic cover comprises a plurality of micro holes.

10. The micro switch device of claim 1, wherein the electrostatic cover is in a disc shape or a star shape.

11. A micro switch device comprising:

a switch substrate having an input terminal, an output terminal, a first driving electrode, and a second driving electrode;

a dome shaped electrostatic cover physically separated from the switch substrate, comprising a first insulation layer which faces the first driving electrode and an conductive layer formed on the first insulation layer to be electrically connected to the second driving electrode, wherein a connection electrode is formed on a bottom of the first insulation layer between the input terminal and the output terminal to electrically connect the input terminal and the output terminal; and a bezel circumferentially formed along the electrostatic cover, and spaced apart a predetermined distance from a circumference of the electrostatic cover.

12. The micro switch device of claim 11, wherein the second driving electrode is circumferentially formed along the bezel, and the first driving electrode is formed between the second driving electrode, the input terminal, and the output terminal.

13. The micro switch device of claim 11, wherein the bezel is capable of electrically connecting the conductive layer with the second driving electrode.

14. The micro switch device of claim 11, wherein the electrostatic cover comprises the second insulation layer which is formed on another surface of the conductive layer corresponding to the first insulation layer.

15. The micro switch device of claim 14, wherein the conductive layer has one of a tensile and a compressive residual stress, wherein the conductive layer residual stress is different from the first insulation layer residual stress and the second insulation layer residual stress.

16. The micro switch device of claim 11, wherein the electrostatic cover comprises a plurality of micro holes.

17. A micro switch device comprising:

a switch substrate having an input terminal, an output terminal, a first driving electrode, and a second driving electrode;

an electrostatic cover formed substantially in a dome shape to be physically separated from the switch substrate, and comprising a first insulation layer which faces the first driving electrode and a conductive layer formed on the first insulation layer to be electrically connected to the second driving electrode, wherein a connection electrode is formed on a bottom of the first insulation layer between the input terminal and the output terminal to electrically connect the input terminal and the output terminal; and a bezel circumferentially formed along the electrostatic cover, and spaced apart a predetermined space from a circumference of the electrostatic cover; and an electrode bridge electrically connecting either the input terminal or the output terminal to the connection electrode.

18. The micro switch device of claim 17, wherein the second driving electrode is circumferentially formed along the bezel, either the input terminal or the output terminal is connected to the electrode bridge in a circumference of the electrostatic cover, a remaining one of the input terminal or the output terminal is formed on a bottom of the connection electrode, and the first driving electrode is formed between the second driving electrode and the remaining terminal.

19. The micro switch device of claim 17, wherein the bezel is capable of electrically connecting the conductive layer with the second driving electrode.

20. The micro switch device of claim 17, wherein the electrostatic cover comprises the second insulation layer which is formed on another surface of the conductive layer corresponding to the first insulation layer.

21. The micro switch device of claim 20, wherein the conductive layer has one of a tensile and a compressive residual stress, wherein the conductive layer residual stress is different from the first insulation layer residual stress and the second insulation layer residual stress.

22. The micro switch device of claim 17, wherein the electrostatic cover comprises a plurality of micro holes.

23. The micro switch device of claim 17, wherein the electrostatic cover is in a star shape.

24. A micro switch device manufacturing method comprising:

forming an input terminal, an output terminal, a first driving electrode, and a second driving electrode;

forming a first sacrificial layer on a switch substrate;

forming an electrostatic cover which has a connection electrode on the switch substrate on which the first sacrificial layer is formed;

forming a second sacrificial layer on the electrostatic cover;

forming a bezel in a circumference of the second sacrificial layer; and eliminating the first and second sacrificial layers.

25. The method of claim 24, wherein the second driving electrode is circumferentially formed along the electrostatic cover, and the bezel is formed on the second sacrificial layer to partially cover the electrostatic cover.

26. The method of claim 24, wherein the forming of the electrostatic cover comprises:

forming the connection electrode on the first sacrificial layer, forming a first insulation layer on the connection electrode and the first sacrificial layer, and forming a conductive layer on the first insulation layer.

27. The method of claim 26, wherein the forming of the electrostatic cover further comprises forming a second insulation layer on the conductive layer, wherein the conductive layer has one of a tensile and a compressive residual stress, wherein the conductive layer residual stress is different from the first insulation layer residual stress and the second insulation layer residual stress.

28. The method of claim 24, wherein the forming of the electrostatic cover comprises forming a plurality of micro holes on the electrostatic cover.

* * * * *